United States Patent [19]

Ohno

[11] Patent Number: 4,561,338

[45] Date of Patent: Dec. 31, 1985

[54] AUTOMATIC ACCOMPANIMENT APPARATUS

[75] Inventor: Hiroko Ohno, Tokyo, Japan

[73] Assignee: Casio Computer Co., Ltd., Tokyo, Japan

[21] Appl. No.: 642,724

[22] Filed: Aug. 17, 1984

Related U.S. Application Data

[63] Continuation of Ser. No. 415,350, Sep. 7, 1982.

[30] Foreign Application Priority Data

Sep. 14, 1981 [JP] Japan ..... 56-144959

[51] Int. Cl.[4] ..... G10F 1/00

[52] U.S. Cl. ..... 84/1.03; 84/DIG. 22; 84/DIG. 12

[58] Field of Search ..... 84/1.01, 1.03, 1.24, 84/DIG. 12, DIG. 22

[56] References Cited

U.S. PATENT DOCUMENTS 4,220,068 9/1980 Howell et al. ..... 84/1.03
4,248,118 2/1981 Hall et al. ..... 84/1.01
4,344,345 8/1982 Sano ..... 84/1.03
4,433,601 2/1984 Hall et al. ..... 84/1.03

FOREIGN PATENT DOCUMENTS 2806978 8/1978 Fed. Rep. of Germany .
3023559 2/1981 Fed. Rep. of Germany .

*Primary Examiner*—Forester W. Isen
*Attorney, Agent, or Firm*—Frishauf, Holtz, Goodman & Woodward

[57] ABSTRACT

A ROM has 16 memory locations of addresses No. 0 to No. 15. Bass pattern data for the first bar are stored in the memory locations of the addresses No. 0 to No. 7, and bass pattern data for the second bar are stored in the memory locations of the addresses No. 8 to No. 15. The memory locations of the addresses No. 0 to No. 7 are specified by respective counts "0" to "7" of a hexadecimal counter, and the memory locations of the addresses No. 8 to No. 15 are specified by respective counts "8" to "15" of the counter. The output of the counter for the counts "8" to "15" is supplied through a gate circuit to the ROM. The gate circuit is inhibited by the output of a chord designating key section.

12 Claims, 14 Drawing Figures

FIG. 1
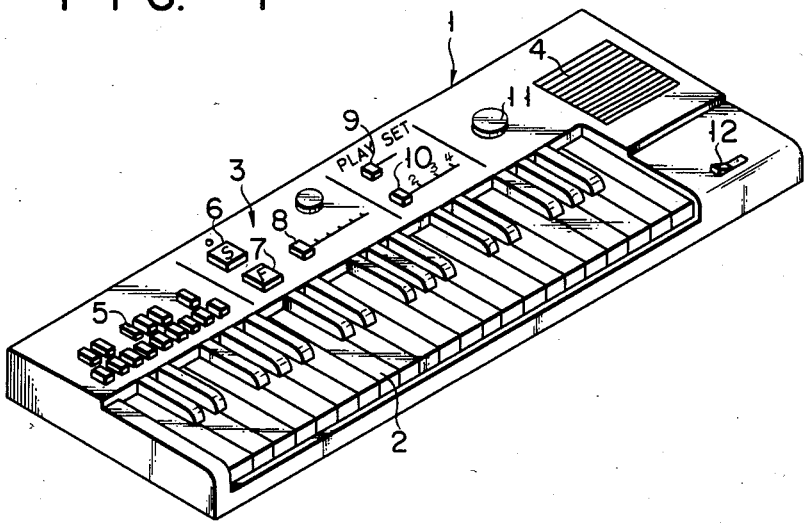
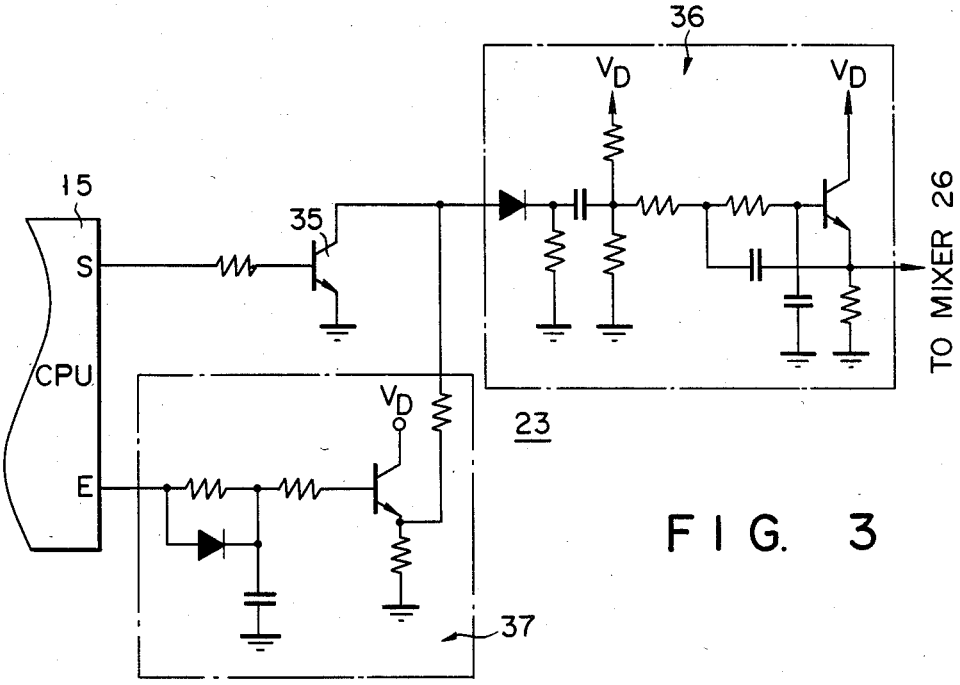
FIG. 3

FIG. 4

| | BD | SN | HH | CL | SYM |
|---|---|---|---|---|---|
| 0 | 1 | 0 | 1 | 0 | 0 |
| 1 | 0 | 0 | 1 | 0 | 0 |
| 2 | 0 | 1 | 0 | 0 | 0 |
| 3 | 1 | 1 | 1 | 0 | 0 |
| 4 | 1 | 0 | 1 | 0 | 0 |
| 5 | 0 | 0 | 1 | 0 | 0 |
| 6 | 0 | 1 | 0 | 0 | 0 |
| 7 | 0 | 0 | 1 | 0 | 0 |
| 8 | 1 | 0 | 1 | 0 | 0 |
| 9 | 0 | 0 | 1 | 0 | 0 |
| 10 | 0 | 1 | 0 | 0 | 0 |
| 11 | 1 | 1 | 1 | 0 | 0 |
| 12 | 1 | 0 | 1 | 0 | 0 |
| 13 | 0 | 0 | 1 | 0 | 0 |
| 14 | 0 | 1 | 0 | 0 | 0 |
| 15 | 0 | 0 | 1 | 0 | 0 |

FIG. 5

| | CODE | | | | |
|---|---|---|---|---|---|
| 0 | 0 | 0 | 0 | 0 | 0 |
| 1 | 1 | 1 | 1 | 1 | 1 |
| 2 | 1 | 1 | 1 | 1 | 1 |
| 3 | 0 | 0 | 0 | 0 | 0 |
| 4 | 0 | 0 | 1 | 1 | 1 |
| 5 | 1 | 1 | 1 | 1 | 1 |
| 6 | 1 | 1 | 1 | 1 | 1 |
| 7 | 0 | 0 | 1 | 1 | 1 |
| 8 | 0 | 0 | 0 | 0 | 0 |
| 9 | 1 | 1 | 1 | 1 | 1 |
| 10 | 1 | 0 | 1 | 1 | 1 |
| 11 | 1 | 1 | 1 | 1 | 1 |
| 12 | 1 | 1 | 0 | 0 | 1 |
| 13 | 1 | 1 | 1 | 1 | 1 |
| 14 | 1 | 1 | 0 | 1 | 1 |
| 15 | 1 | 1 | 1 | 1 | 1 |

AUTOMATIC ACCOMPANIMENT APPARATUS

This application is a continuation, of application Ser. No. 415,350 filed Sept. 7, 1982.

BACKGROUND OF THE INVENTION

This invention relates to an automatic accompaniment apparatus.

The prior art automatic accompaniment apparatus usually produces an automatic accompaniment consisting of bass tones, using a bass pattern consisting of a series of bass tones for one bar, or for two or more bars. Where a bass pattern is set for each bar, by designating a given chord at the start of a bar, automatic accompaniment having a bass pattern corresponding to the designated chord can be produced for the successive bars. However, where a bass pattern is set for two successive bars, it sometimes happens that a chord different from the previously designated chord is designated at the start of the second bar. In this case, the bass pattern specified later does not start from the start of the first bar but starts from the second bar. The result is that the progress of the bass accompaniment does not naturally fit the progress of the melody, so that the performance is extremely impaired.

In addition, where a bass pattern is set for two bars as a unit, two bars are always covered by a single bass pattern so that the accompaniment is rather monotonous.

SUMMARY OF THE INVENTION

An object of the invention is to provide an automatic accompaniment apparatus, which permits changing the designated chord during performance without the possibility of spoiling the performance effect, and also permits desired performance effects to be obtained satisfactorily with a change of the bass pattern by changing the designated chord.

According to the invention, the above object is attained by an automatic accompaniment apparatus, which comprises storing means for storing a plurality of bass patterns set with respect to predetermined chords, means for designating the chords, control means for making access to predetermined address memory locations of the storing means according to the timing of designation by the chord designating means and a specified interval with respect to the progress of a bass pattern, to thereby read out the corresponding bass pattern data, and means for producing bass tones according to the bass pattern data read out from the reading control means.

BRIEF DESCRIPTION OF THE DRAWINGS

FIG. 1 is a perspective view showing an embodiment of the automatic accompaniment apparatus according to the invention;

FIG. 3 is a circuit diagram showing an example of a tone generating section shown in FIG. 2;

FIG. 4 is a view showing coded rhythm pattern data stored in a ROM shown in FIG. 2;

FIG. 5 is a view showing coded bass pattern data stored in the ROM shown in FIG. 2;

DETAILED DESCRIPTION OF THE PREFERRED EMBODIMENT

Figure 2:
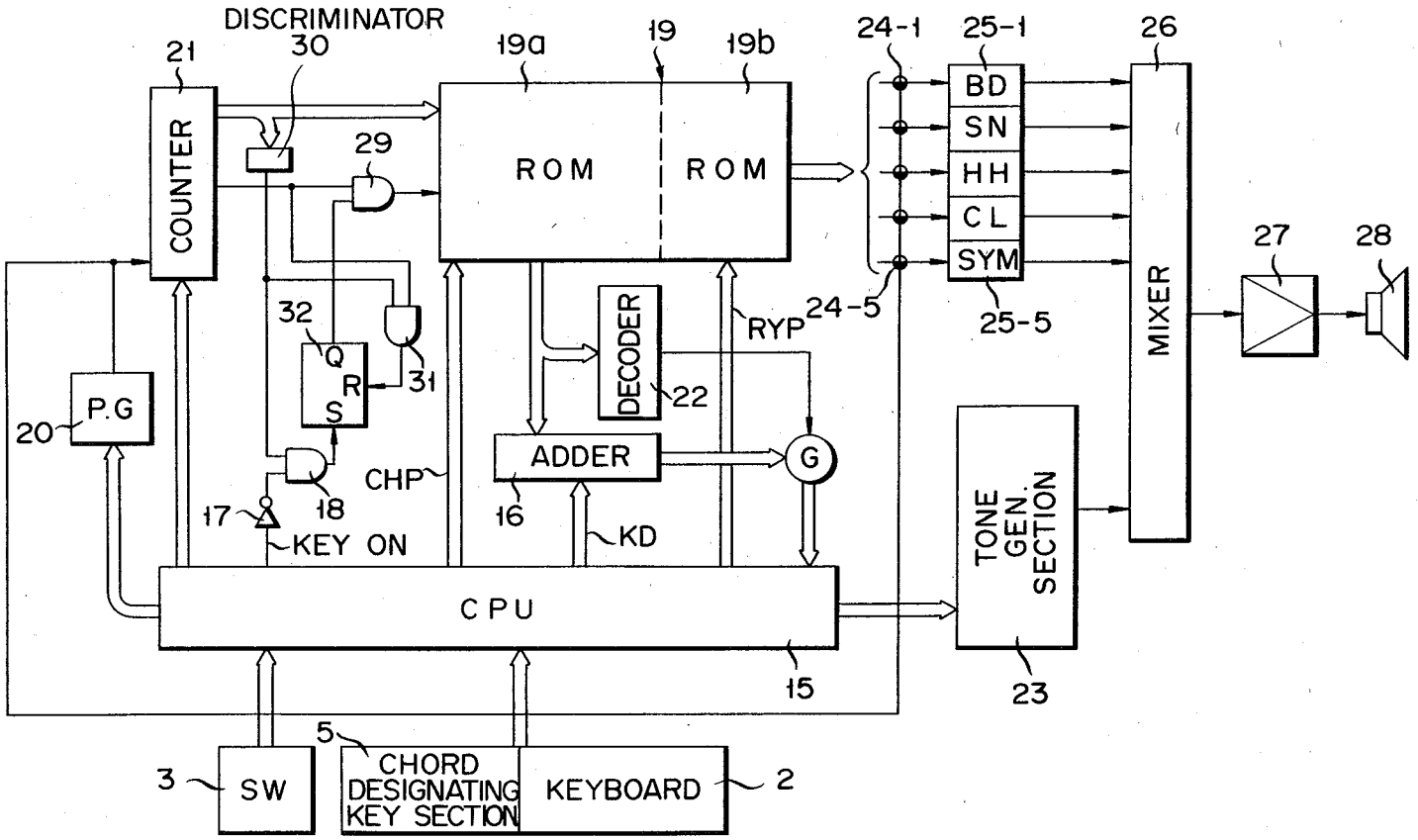
FIG. 2 is a block diagram showing a circuit system in the embodiment of FIG. 1.

Referring to FIG. 1, there is shown an electronic musical instrument having a case 1, on which a keyboard 2, a switch operating section 3 and a sound producing section 4 are provided. The sound producing section 4 includes a loudspeaker. In the case 1, an LSI circuit system as shown in FIGS. 2 and 3 is accommodated.

The switch operating section 3 includes a chord designating key section 5 having a plurality of keys for designating chords, a rhythm start switch 6, a fill-in switch 7, a rhythm select switch 8 for selecting one of six rhythm patterns stored in a ROM (read only memory) to be described later, a PLAY/SET switch 9 for setting a desired tone color in a tone memory (not shown) for obtaining performance in the set tone color, a tone memory selector 10, a volume control knob 11 and a power switch 12.

The circuit of the automatic accompaniment apparatus embodying the invention will be described with reference to FIGS. 2 and 3. Outputs from keys in the keyboard 2 and chord designating key section 5, and switch outputs from the switch operating section 3 are supplied to a CPU (central processing unit) 15. The CPU 15 consists of, for instance, a microprocessor and can control various operations of the electronic musical instrument such as formation of melody tones and accompaniment tones.

In an automatic accompaniment mode, when the chord designating key section 5 is operated, the CPU 15 discriminates the specified chord and supplies key data KD therefor to an adder 16. Further, data specifying the major, minor, 7-th, etc. is supplied from the CPU 15 through a bus line CHP to a ROM (read only memory) **19*a* in a ROM section 19. In the ROM 19*a* bass patterns are stored. When one of the button switches in the chord designating key section 5 is depressed, data specifying a major chord with the corresponding tone as root is produced from the CPU 15. When two button switches in the section 5 are depressed at a time, data specifying a minor chord with the lower one of the corresponding tones as a root is produced. When three or more button switches in the section 5 are depressed at a time, data representing a 7-th chord with the lowest one of the corresponding tones as a root is produced. While a switch in the chord designating key section 5 is "on", a key-on signal of binary logic level "1" is provided to an AND gate 18 through an inverter 17. The CPU 15 further provides, in response to an output from the rhythm select switch 8, a rhythm pattern select signal RYP supplied to a ROM 19*b*. According to the content of the rhythm pattern select signal, the CPU 15 provides a control signal to an oscillator or pulse generator 20 for switching the oscillating frequency of the oscillator 20. At the same time, the CPU 15 produces a control signal to a counter 21 for switching the count capacity of the counter 21**.

Figure 6:
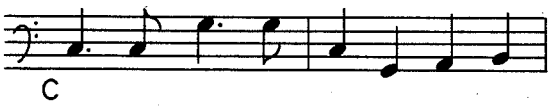
FIGS. 6 and 7 are views showing scores having bass patterns set with respect to the C major chord and F major chord, respectively.
Figure 7:
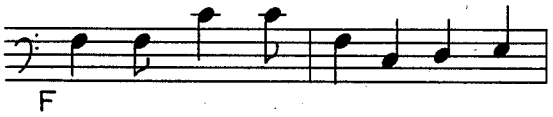

The ROM section 19 includes the ROMs 19*a* and 19*b*. FIGS. 4 and 5 show examples of the respective ROMs 19*a* and 19*b*. These ROMs each have 16 memory locations of addresses No. 0 to No. 15. In the ROM 19*a* five different rhythm pattern data are stored in each memory location. In the ROM 19*b* 5-bit bass pattern data is stored in each memory location. The following description concerns major chords, but the same applies to the other kinds of chords. In the case where eight quaver notes are contained in one bar, the corresponding rhythm pattern data and bass pattern data are stored in the the memory locations of addresses No. 0 to No. 15 of the ROMs 19*a* and 19*b*. The bass pattern data, which are 5-bit data, are specified with respect to the root of chords. A 5-bit all "1" data such as those in the memory locations of addresses No. 1 and No. 2 in the ROM 19*b* in FIG. 5 represents a silence state. The bass pattern data with respect to the roots, C, C#, D, D#, E, F, F#, G, G#, A, A# and B are obtained by adding the key data KD mentioned above to the bass pattern data in the adder 16. FIGS. 6 and 7 show scores of bass patterns corresponding to specified rhythm patterns, with the root of the specified chords being C and F in major, respectively.

Figure 8:
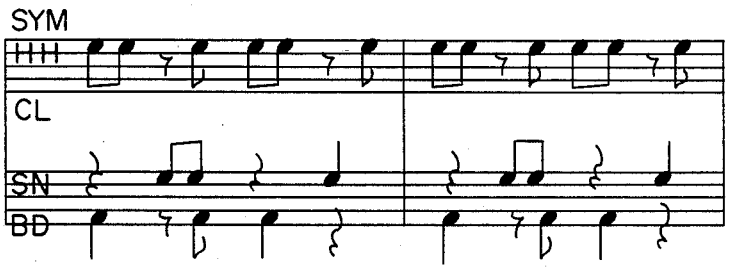
FIG. 8 is a view showing a score of rhythm pattern data.

The rhythm pattern data are 5-bit parallel data specifying percussion musical instruments, namely bass drum (BD), snare drum (SN) high-hat (HH), claves (CL) and cymbal (SYM) as shown in FIG. 4. The score of the rhythm is shown in FIG. 8. A percussion musical instrument sound is produced when the percussion musical instrument data is "1", and no percussion musical instrument data is produced when the data is "0".

The bass pattern data read out from the ROM 19*a* is supplied to the adder 16 and also to a discriminator or decoder 22. The adder 16 adds the bass pattern data and key data KD to produce bass pattern data for the root of the specified chord. The bass pattern data is supplied to a tone generating section 23 through a gate circuit G and CPU 15. The discriminator 22 discriminates 5-bit all "1" data among the bass pattern data. The gate circuit G is on-off controlled by the output of the discriminator 22. The discriminator 22 may be a 5-input AND gate. When the signal supplied to discriminator 22 represents a 5-bit all "1" data, the discriminator 22 provides a "0" signal to close the gate circuit G so as to stop the formation of the bass tones.

The rhythm pattern data (i.e., 5-bit parallel data) read out from the ROM 19*a* is supplied through transfer gates 24-1 to 24-5 to rhythm tone source circuits 25-1 to 25-5. The outputs (rhythm tones) of the rhythm tone source circuits 25-1 to 25-5 are supplied to a mixer 26. The transfer gates 24-1 to 24-5 are on-off controlled according to the output of the oscillator 20.

To the mixer 26 are also supplied tones including bass tones (and also tones produced according to the operation of the keyboard 2) supplied from the tone generating section 23. The mixer 26 mixes the rhythm tone and melody tone, and its output is supplied through an amplifier 27 to the loudspeaker 28 in the sound producing section 4 for producing the accompaniment.

Figure 9:
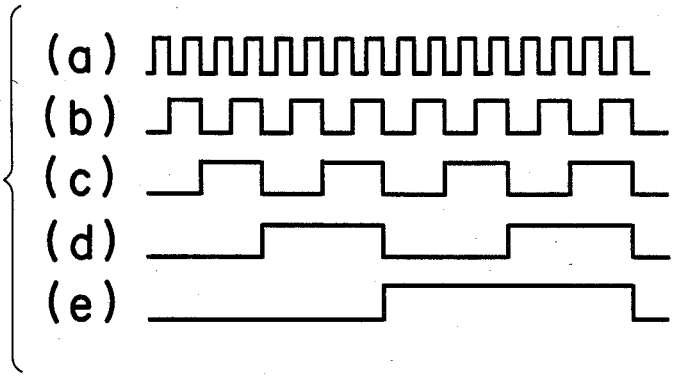
FIG. 9 is a time chart showing the waveform of an input to a hexadecimal counter and the waveforms of four bit outputs of the counter.

A circuit for controlling the reading of data from the ROM 19*a* will now be described. The output signal of the oscillator 20 (FIG. 9*a*) is supplied to a counter 21 for counting. The counter 21 is, for instance, a 4-bit hexadecimal counter. FIG. 9 shows the individual bit outputs of the counter 21 from the lowest bit. The lowest three bit data provided from the counter 21, shown at (b) to (d) in FIG. 9, are directly supplied as address data to the ROM 19*a*. The highest bit data shown at (e) in FIG. 9 is supplied as address data to the ROM 19*a* through an AND gate 29. The lowest three bit data are also supplied to a discriminator 30. The discriminator 30 checks if the input data is all "1" data. If the input data is all "1" data (i.e., if the count of the counter 21 is either "7" or "5"), the discriminator 30 discriminates a signal of "1" level, which is supplied to the AND gate 18 and also to an AND gate 31. To the AND gate 31 is also supplied the highest bit data from the counter 21, and the output of the AND gate 31 is supplied to the reset input terminal R of an S-R flip-flop 32. The output of the AND gate 18 is applied to the set input terminal of the flip-flop 32, and the set or Q output signal thereof is supplied as a gate control signal to an AND gate 29. For the second bar, unless the chord designating key section 5 is operated, the flip-flop 32 is set to specify the memory locations of the addresses No. 8 to No. 15 in the ROM 19. If the section 5 is operated for the second bar, the addresses NO. 0 to No. 7 are specified. In this case, the same bass pattern as for the first bar is read out. In case a key in the section 5 is kept depressed for the first and second bars, the bass pattern data for the first bar is again provided for the second bar. The operation in this respect will be described later in detail.

With the reading control circuit having the construction as described above, bass pattern data of different contents can be read out according to the timing of depression or the length of time of depression of keys in the chord designating key section 5. Thus, natural progress of bass can be obtained. Also, it is possible to expand the scope of performance techniques.

FIG. 3 shows a specific circuit of a bass tone generating section in the tone generating section 23. When the CPU 15 receives a bass pattern data from the adder 16, it produces a tone frequency signal from its output terminal S. The tone frequency signal is supplied to a tone color circuit (filter) 36 through a transistor 35. At the same time, the CPU 15 produces from its output terminal E an envelope control signal supplied to an envelope generator 37. The envelope generator 37 produces an envelope waveform signal by making use of the charging and discharging of a capacitor. The envelope waveform signal is supplied to the tone color circuit 36. The tone color circuit 36 multiplies the tone frequency signal by the envelope waveform signal to produce a signal representing a bass tone provided with a tone color. This signal is supplied to the mixer.

Now, the operation when producing various bass pattern data will be described with reference to FIGS. 10 and 12. Before starting the automatic accompaniment, the rhythm select switch 8 is set to a desired position. It is assumed that the three rhythm patterns HH, SN and BD as shown in FIG. 8 are selected. As a result, a rhythm pattern select signal RYP specifying the selected rhythm patterns in the ROM 19*b* is produced from the CPU 15, and bass pattern corresponding to the selected rhythm patterns are selected according to the rhythm pattern select signal RYP and the signal CHP. The CPU 15 provides a control signal to the counter 21 for operating the counter as a hexadecimal counter. The CPU 15 also provides a control signal to the oscillator 20 for producing a signal at a frequency corresponding to the hexadecimal operation of the counter 21.

Figure 10:
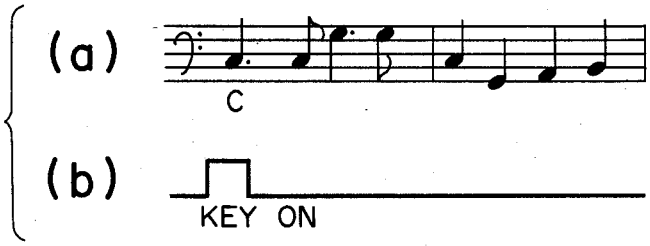
FIGS. 10 to 12 are views showing different bass patterns obtained with different chord designation timings and different specified intervals.

Then, it is assumed that the rhythm start switch 6 is depressed, and the key for the note C in the chord designating section 5 is depressed at the leading end of the bar, as shown in FIG. 10. As a result, the counter 21 commences its operation as a hexadecimal counter, producing the individual bit outputs as shown in FIG. 9. When the key for the note C is depressed, a key-on signal of "1" level is provided from the CPU 15. At this time, however, the flip-flop 32 is not set but remains reset.

The lowest three-bit data of the counter 21 are directly supplied to the ROM section 19. Thus, while the count of the counter 21 is "0" to "6", i.e., before the lowest 3-bit data of the counter 21 becomes all "1" data, memory locations of the addresses No. 0 to No. 6 in the ROM section 19 are successively accessed. The rhythm pattern data shown in FIG. 8 and also the bass pattern data shown in FIG. 10 are thus successively read out from the memory locations of the addresses No. 0 to No. 6 in the ROM section 19. The bass pattern data are supplied to the adder 16 and discriminator 22. The rhythm pattern data are supplied to the rhythm tone source circuits 25-1 to 25-5 through the transfer gates 24-1 to 24-5. Since the note C has been specified, the CPU 15 provides the corresponding key data KD to the adder 16. According to the key data KD the adder 16 adds "0" to the bass pattern data from the ROM 19*a*, that is, the adder 16 directly passes the data for the note C to the CPU 15 through the gate circuit G. The CPU 15 produces from its output terminals S and E (FIG. 3) the tone frequency signal and envelope control signal corresponding to the input data. These signals are supplied to the respective tone color circuit 36 and envelope generator 37 in the tone generating section 23. When the discriminator 22 detects all "1" data as the input data, the gate circuit G is closed. As a result, bass tones are produced in the tone generating section 23 according to the bass pattern data read out from the memory locations of the addresses No. 0 to No. 6 in the ROM 19*a*. These tones are supplied to the mixer 26.

During this time, rhythm tones are provided from the rhythm tone source circuits 25-1 to 25-5 according to the rhythm pattern data from the memory locations of the addresses No. 0 to No. 6 in the ROM 19*b*. These rhythm tones are supplied to the mixer 26. In the mixer 26, the bass tones and rhythm tones are mixed, and the resultant output is supplied to the sound producing section 4 to produce the automatic accompaniment.

When the count of the counter 21 becomes "7", that is, when the lowest three-bit outputs of the counter 21 become all "1", the discriminator 30 produces a "1" signal supplied to the AND gate 18. Since at this time the section 5 is not operated, the output of the inverter 17 is "1", and hence the output of the AND gate 18 is "1", so that the flip-flop 32 is set. With the set output "1" the AND gate 29 is opened. In this state, the accompaniment is produced according to the bass pattern data and rhythm pattern data read out from the memory locations of the address No. 7 in the ROMs 19*a* and 19*b*.

With the subsequent change of the count of the counter 21 to "8", the highest bit output is changed to "1". Subsequently, the output of the AND gate 29 is provided as "1" output to the ROMs 19*a* and 19*b*. Thus, the memory locations of the addresses No. 8 to No. 15 in the ROMs 19*a* and 19*b* are subsequently accessed, and the corresponding bass pattern data are read out to produce the accompaniment.

In the above operation, the bass pattern data for the second bar are read out from the memory locations of the addresses No. 8 to No. 15 in the ROM 19. Thus, the bass tones and rhythm tones of the chord C major as shown in FIG. 10 are supplied to the sound producing section 28 to produce the accompaniment. When the second bar is ended, the accompaniment is started again from the first bar.

Figure 11:
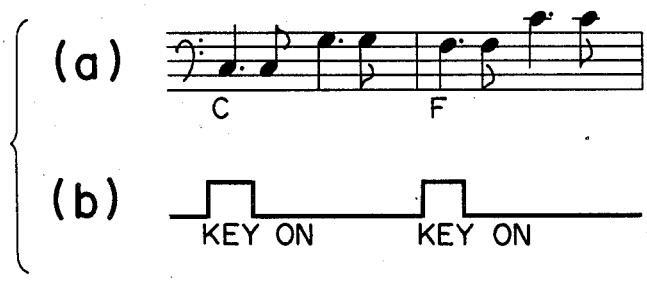

Now, the operation will be described in connection with the case of depressing the key for the note C at the start of the first bar and depressing the key for the note F at the start of the second bar. In this case, the same operation as described above in connection with FIG. 10 is executed while the count of the counter 21 is "0" to "7". Thus, for the first bar the bass tones of the chord C major are produced as shown in FIG. 11.

As soon as the key for the note F is depressed at the start of the second bar, at which time the count of the counter 21 becomes "8", a "1" level key-on signal is provided from the CPU 15 to bring the output of the AND gate 18 to "0". At the same time, the output of the AND gate 31 becomes "1". Thus, the flip-flop 32 remains reset. Since the set output of the flip-flop 32 thus remains "0", the AND gate 29 is closed. As a result, the "1" signal as the highest bit output of the counter 21 is supplied to the ROMs 19*a* and 19*b*. Thus, the memory locations of the addresses No. 0 to No. 7 in the ROMs 19*a* and 19*b* are again successively accessed according to the lowest three-bit data of the counter 21.

Meanwhile, with the specification of the chord F major, the CPU 15 subsequently supplies key data KD representing the note F to the adder 16. The adder 16 thus subsequently adds the bass pattern data read out from the ROM 19*a* and predetermined data based on the key data KD to provide the bass pattern data corresponding to the chord F major, to the CPU 15. Thus, bass tones of the chord F major are produced for the second bar as shown in FIG. 11. In this case, the bass tones are produced from the first bar of the bass pattern of the chord F major.

When the second bar of the chord F major is ended, the counter 21 is reset. Then, the bass tones for the first bar and then the second bar of the chord F major are subsequently produced repeatedly.

Figure 12:
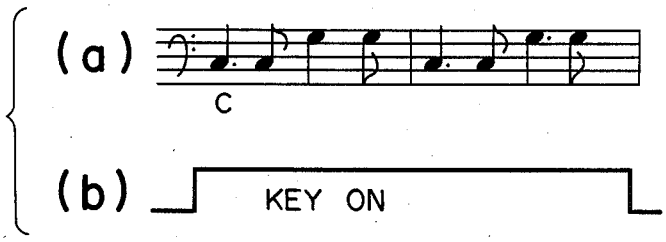

Now, the operation will be described in connection with the case when the key for the note C is kept depressed from the start of the first bar till the end of the second bar as shown in FIG. 12. In this case, the "1" level key-on signal is continuously provided to hold the AND gate 18 closed. Thus, when the count of the counter 21 reaches "7" so that its lowest three-bit data become all "1" to change the output of the discriminator 30 to "1", the flip-flop 32 is not set, that is, the flip-flop 32 is always held reset. Thus, while the count of the counter 21 is "0" to "7", bass tones for the first bar of the chord C major are produced as shown in FIG. 5. While the count of the counter 21 is "8" to "15", the highest bit signal of the counter 21 is null, so that during this time the bass tones for the first bar of the chord C major bass pattern are produced. That is, the bass tones for the first bar of the chord C major bass pattern are repeatedly produced for the second bar.

Figure 13:
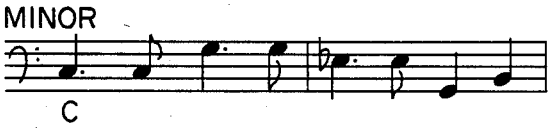
FIGS. 13 and 14 are views showing scores of bass pattern data obtained by designating the C minor chord and C 7-th chord, respectively.
Figure 14:
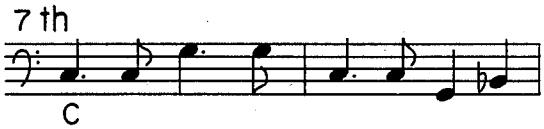

While the above description is concerned with the operations in which a major chord is specified, similar operations are obtained in case when a minor or 7-th chord is specified. FIGS. 13 and 14 show scores of bass pattern when the C minor chord and C 7-th chord are specified respectively in the chord designating key section 5. The bass pattern data coresponding to the minor and 7-th chords as well as the major chords are thus stored in the ROM 19*a*.

While in the above embodiment rhythm patterns for two bars have been stored in the ROM 19*b*, it is of course sufficient to store pattern data only for one bar.

While in the above embodiment only bass tones have been produced, it is also possible to permit chords to be produced together with bass tones. In this case, it is possible to permit a chord rhythm pattern for two bars to be provided as a recurring one-bar pattern similar to the pattern described above according to the switch operation. Further, the kinds and number of rhythm tone sources in the above embodiment are by one means limitative and can be suitably selected. Further, while the above embodiment is concerned with patterns for two bars, this is by no means limitative, and it is possible to provide for patterns for three or more bars. Various further changes and modifications are also possible without departing from the scope of the invention.

As has been described in the foregoing, with the automatic accompaniment apparatus according to the invention, in which different bass patterns can be obtained according to the timing of specification and specified interval of chords, by switching the bass pattern according to the specified chord at the start of a bar, the bass pattern corresponding to the specified chord can be produced from the instant of switching, i.e., from the first bar of that bass pattern. This is advantageous from the standpoint of the natural progress of the bass.

Further, by varying the timing of specification and specified interval of chords, it is possible to provide various bass patterns such as recurring one-bar patterns. This permits expansion of the scope of application of performance techniques, permitting increased musical effects to be obtained.

What is claimed is:

1. An automatic accompaniment apparatus for performing a music piece having a plurality of predefined measures, each of said plurality of measures having the same given number of beats, comprising:

bass pattern memory means for storing a plurality of bass pattern data at corresponding address locations, wherein at least one of said plurality of bass pattern data represents a pattern extending for more than one measure of said musical piece being performed;

a keyboard including a plurality of accompaniment keys;

chord designating means coupled to said keyboard for designating a chord in accordance with an operation of the accompaniment keys;

detecting means for detecting the same accompaniment keys which are operated continuously in a given measure and at least in a portion of a next successive measure;

read control means for reading out a bass pattern from said bass pattern memory means according to the designated chord by said chord designating means, and including a means for reading out repeatedly a predetermined measure of the at least one bass pattern when said detecting means detects that the same accompaniment keys are continuously operated in said given measure and at least in a portion of said next successive measure; and bass tone producing means for producing bass tones according to the bass pattern data read out by said reading control means.

2. The automatic accompaniment apparatus according to claim 1, wherein said predetermined measure which is repeatedly read out by said reading out means is the first measure of said at least one bass pattern.

3. The automatic accompaniment apparatus according to claim 1, wherein said at least one bass pattern extending for more than one measure extends for four measures.

4. The automatic accompaniment apparatus according to claim 3 wherein said predetermined measure which is repeatedly read out by said reading out means is the first measure of said at least one bass pattern.

5. The automatic accompaniment apparatus according to claim 1, wherein said reading control means includes means for generating pulse signals to regulate the progress of a bass pattern, means for counting said pulse signals, and means for forming an address signal for accessing said storing means according to a count value associated with said counting means.

6. The automatic accompaniment apparatus according to claim 5, wherein said address signal forming means includes means for forming a first address signal according to the count value of said counting means wherein said first address signal corresponds to the first measure of said pattern formed of more than one measure, means for forming a second address signal according to the count value of said counting means wherein said second address signal corresponds to a second measure of said pattern formed of more than one measure, and means for inhibiting the output of said second address signal forming means in accordance with the output of said chord designating means.

7. The automatic accompaniment apparatus according to claim 6, wherein said inhibiting means includes a flip-flop arranged to be in a set state in the absence of an output from said chord designating means, and a gate circuit for supplying said second address signal to said storing means in response to a set output of said flip-flop.

8. An automatic accompaniment apparatus for performing a music piece having a plurality of predefined measures, each of said plurality of measures having the same given number of beats, comprising:

bass pattern memory means for storing a plurality of bass pattern data at corresponding address locations, wherein at least one of said plurality of bass pattern data represents a pattern extending for more than one measure of said musical piece being performed;

a keyboard including a plurality of accompaniment keys;

chord designating means coupled to said keyboard for designating a chord in accordance with an operation of the accompaniment keys, and including means for designating the same chord after said accompaniment keys are released;

first detecting means responsive to operation of said accompaniment keys for supplying a first detecting signal when the accompaniment keys which are operated continuously in a given measure and at least in a portion of a next successive measure;

second detecting means for supplying a second detecting signal when the accompaniment keys which are operated in said given measure are released in the next successive measure and remain released over the length of said stored bass pattern;

reading control means for reading out a bass pattern from said bass pattern memory means according to the designated chord by said chord designating means, said reading control means including:

means for reading out repeatedly a predetermined measure of a plural measure bass pattern when said first detecting means supplies the first detecting signal, and means for reading out every measure of said plural measure bass pattern after said second detecting means supplies said second detecting signal; and bass tone producing means for producing bass tones according to the bass pattern data read out by said reading control means.

9. The automatic accompaniment apparatus according to claim 8, wherein said plural measure bass pattern extends for four measures.

10. The automatic accompaniment apparatus according to claim 8, wherein said reading control means includes means for generating pulse signals to regulate the progress of a bass pattern, means for counting said pulse signals, and means for forming an address signal for accessing said storing means according to a count value associated with said counting means.

11. The automatic accompaniment apparatus according to claim 10, wherein said address signal forming means includes means for forming a first address signal according to the count value of said counting means wherein said first address signal corresponds to the first measure of said pattern formed of more than one measure, means for forming a second address signal according to the count value of said counting means wherein said second address signal corresponds to a second measure of said pattern formed of more than one measure, and means for inhibiting the output of said second address signal forming means in accordance with the output of said chord designating means.

12. The automatic accompaniment apparatus according to claim 11, wherein said inhibiting means includes a flip-flop arranged to be in a set state in the absence of an output from said chord designating means, and a gate circuit for supplying said second address signal to said storing means in response to a set output of said flip-flop.

* * * * *